United States Patent [19]

Fuller

[11] 4,179,245

[45] Dec. 18, 1979

[54] ACCELERATION PUMP WITH TEMPERATURE-RESPONSIVE CONTROL OF DELIVERY

[75] Inventor: William A. Fuller, St. Clair Shores, Mich.

[73] Assignee: Colt Industries Operating Corp., New York, N.Y.

[21] Appl. No.: 824,829

[22] Filed: Aug. 15, 1977

[51] Int. Cl.[2] ..... F02M 7/08

[52] U.S. Cl. ..... 417/292; 261/34 A; 261/34 B

[58] Field of Search ..... 417/292, 308, 440; 261/34 B, 34 A; 123/139 AH; 251/118, 120, 117; 137/504

[56] References Cited

U.S. PATENT DOCUMENTS

| | | | |
|---|---|---|---|
| 2,296,732 | 9/1942 | Oyston et al. | 251/120 |
| 2,602,627 | 7/1952 | Britton | 251/DIG. 1 |
| 2,775,435 | 12/1956 | Kommer | 261/34 A |
| 3,186,470 | 6/1965 | Korte | 417/292 |
| 3,313,530 | 4/1967 | Bickhaus et al. | 417/292 |
| 3,911,062 | 10/1975 | Johnson | 261/34 B |
| 4,099,894 | 7/1978 | Indra | 417/499 |

FOREIGN PATENT DOCUMENTS

| | | | |
|---|---|---|---|
| 2289750 | 5/1976 | France | 261/34 B |

*Primary Examiner*—Carlton R. Croyle
*Assistant Examiner*—Thomas I. Ross
*Attorney, Agent, or Firm*—Walter Potoroka, Sr.

[57] ABSTRACT

An accelerating pump system is shown having a chamber into which fuel from a fuel reservoir of fuel bowl is drawn and then, when and as required, ejected, as by a displaceable diaphragm within said chamber, into a passage leading to accelerating fuel nozzle structure for discharge into the induction passage of the related carburetor or fuel metering means; a vent passage serves to communicate between the fuel reservoir and the chamber as to enable a portion of the fuel within the chamber to be returned to the fuel reservoir when the diaphragm is being displaced for ejecting fuel into the said passage; a thermostatic valve serves to preclude such communication between the fuel reservoir and the chamber except when the fuel temperature (employed as an indicia of engine and indirectly ambient temperature) within the chamber attains a predetermined relatively elevated temperature.

11 Claims, 7 Drawing Figures

ACCELERATION PUMP WITH TEMPERATURE-RESPONSIVE CONTROL OF DELIVERY

BACKGROUND OF THE INVENTION

As is generally well known in the art, the main metering system of a carburetor operates on the principle of a pressure differential between the carburetor fuel bowl and the induction passage at the venturi. That is, when the carburetor throttle is opened, the velocity of the air rushing past the induction passage venturi means is increased. This, in turn, decreases the pressure at the main metering nozzle located near the venturi, which results in a greater amount of rate of fuel being delivered into the intake or induction passage from the fuel bowl.

When the throttle is opened suddenly, however, the increase in the flow of fuel lags behind that of the flow of air due to the greater inertia of the heavier fuel. For this reason, carburetors are provided with an accelerating pump adapted to positively supply a predetermined extra amount of fuel when the throttle is opened; this helps to maintain a proper fuel-air ratio until the inertia of the fuel is overcome and the main metering system is back to normal operation.

In the past such accelerating pumps exhibited an objectionable characteristic in that they supplied the same amount of extra fuel at all engine temperatures. The volatility of the fuel varies considerably with change in temperature. Thus, in the past, an accelerating pump which was adjusted to provide just the right amount of extra fuel when the engine (and/or fuel) was cold, provided too much fuel when the engine was relatively hot. Likewise, if such an accelerating pump was set to provide the correct amount of additional fuel when the engine was relatively hot, there was a deficiency of fuel when the engine was cold.

Heretofore, the prior art attempted to overcome the problem of being able to provide differing quantities of additional acceleration fuel for respective relatively cold and hot engine conditions. To that end the prior art, heretofore, had proposed the employment of abutment means with such abutment means being intended to change the effective pump stroke depending on the temperature of the fuel. The abutment means, at least in one form suggested by the prior art, comprised a movable thermostatic member (moved to either of two operating conditions dependent on the sensed temperature of the fuel), carried as by the displaceable portion of the pump structure, which coacted with a cooperating fixed stop.

Although such prior art structures did, to some degree, overcome the problem of providing only a fixed additional amount of fuel regardless of engine (and/or fuel) temperature, such structures have been found difficult to manufacture and also difficult to calibrate. In this respect, the amount of additional fuel during cold engine operation as well as the amount of additional fuel during hot engine operation was totally determined by the same thermostatic member; accordingly, it sometimes became difficult, if not impossible, to provide desired rates of additional fuel flow where such rates were beyond one of the limits intrinsically determined or established by the thermostatic member.

Accordingly, the invention as herein disclosed and claimed is primarily directed to the solution of the aforementioned as well as related and attendant problems.

SUMMARY OF THE INVENTION

According to one aspect of the invention, an accelerating pump assembly comprises a pump chamber communicating through first passage means with the fuel within a fuel reservoir, a displaceable pumping member actuatable to a pumping position as to displace some of the fuel from the chamber and into second discharge passage means, third passage means effective for communicating between said fuel reservoir and said chamber, and temperature responsive valving means effective to prevent free communication between said fuel reservoir and said chamber through said third passage means when the temperature of the associated engine and/or fuel is less than a predetermined magnitude.

Various general and specific objects, advantages and aspects of the invention will become apparent when reference is made to the following detailed description considered in conjunction with the accompanying drawings.

BRIEF DESCRIPTION OF THE DRAWINGS

In the drawings wherein for purposes of clarity certain details and/or elements may be omitted from one or more views.

DETAILED DESCRIPTION OF THE PREFERRED EMBODIMENT

Figure 1:
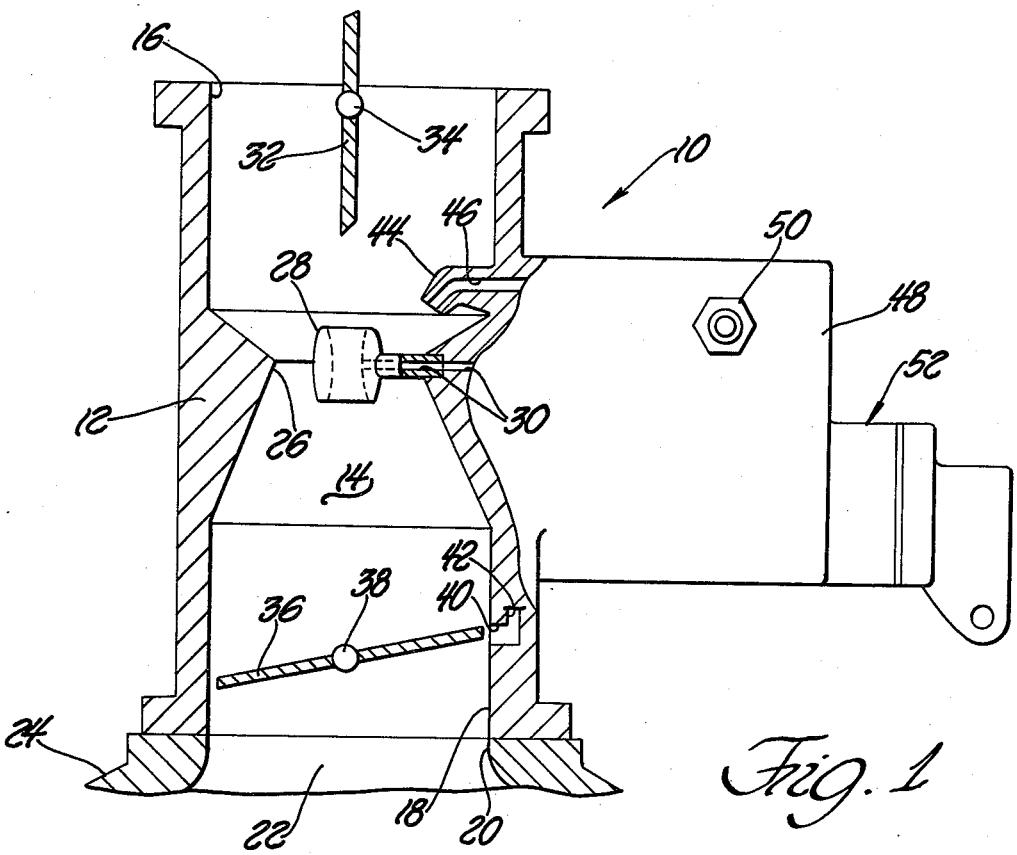
FIG. 1 is an elevational view, partly in vertical axial cross-section, of a carburetor, in simplified form, employing teachings of the invention.
Figure 4:
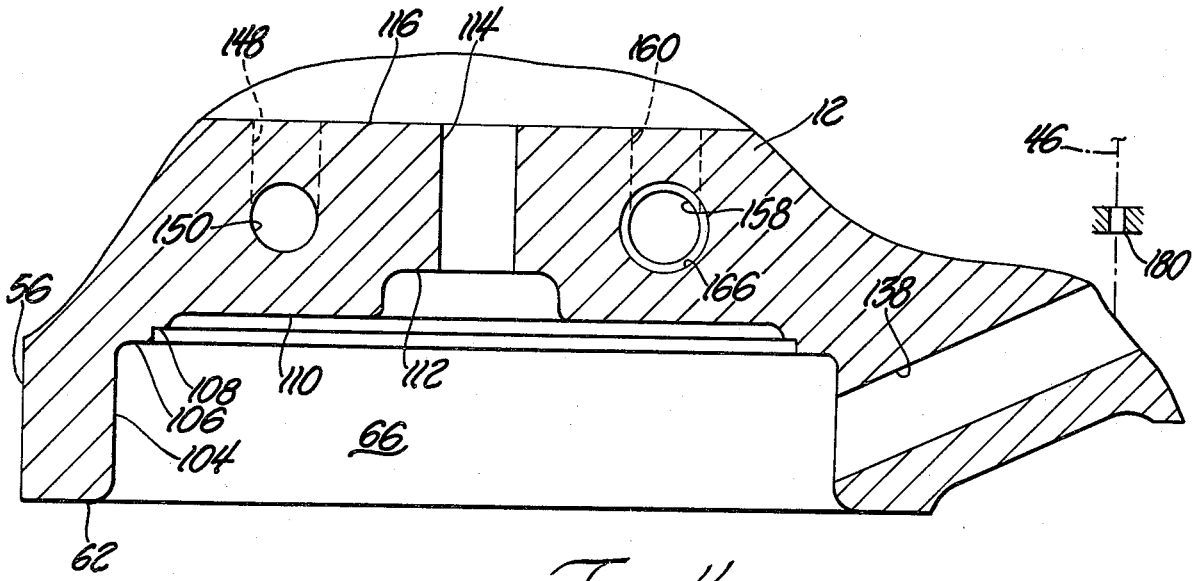
FIG. 4 is a cross-sectional view generally on the plane of line 4—4 of FIG. 3 and looking in the direction of the arrows with certain of the elements in FIG. 3 not being shown in FIG. 4.

Referring now in greater detail in the drawings, FIG. 1 illustrates a carburetor 10 comprising a carburetor body 12 with induction passage means 14 formed therethrough and having an air inlet end 16 (which may communicate with related inlet air cleaner means not shown but well known in the art) and a motive fluid discharge end 18 communicating as with the inlet 20 of passage means 22 defined within intake manifold means 24 of an associated combustion engine. Generally between the inlet and discharge ends 16 and 18, the induction passage 14 is provided with venturi means 26 and, preferably, a main fuel discharge nozzle 28 is situated generally within the throat of said venturi, as in any manner well known in the art, and communicates, as through conduit means 30, with related main fuel metering system means, not shown but also well known in the art.

The inlet end 16 may be provided as with choke valve means 32 carried as by a choke shaft 34 for general pivotal rotation therewithin as is also well known in the art; said choke valve 32 being depicted in a fully opened position.

A throttle valve 36, fixedly secured to related throttle shaft means 38 for selective rotatable positioning within induction passage 14, serves to variably control the rate of discharge of motive fluid into the intake manifold passage means 22. As is generally well known in the art, idle fuel discharge orifice means 40 may be provided, as generally depicted, for supplying metered fuel flow to the induction passage. Such orifice means 40, in turn, may communicate, as via conduit means 42, with related idle fuel metering system means, not shown but well known in the art.

As also depicted, carburetor 10 is also preferably provided with acceleration fuel discharge means which, in the preferred embodiment, may take the configuration of nozzle-like means 44 provided with conduit means 46 communicating with accelerating fuel pumping means in a manner to be described.

Fuel bowl or reservoir means 48, shown to be carried by the carburetor body 12, may be provided with suitable inlet means 50 adapted to receive fuel as from related fuel tank supply means not shown. Further, shown carried by the fuel bowl means 48 is an accelerating fuel pump housing means or portion 52.

Figure 2:
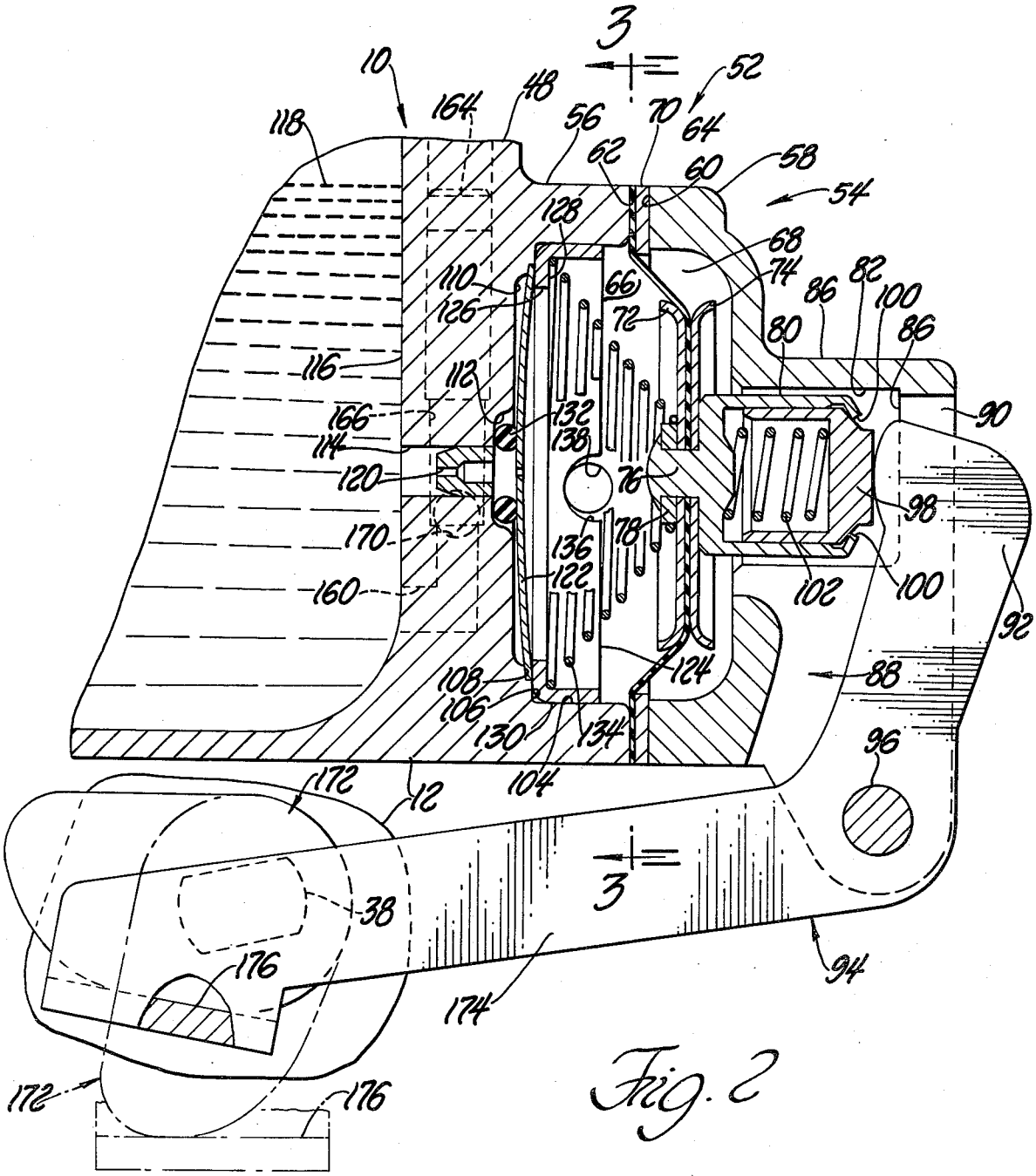
FIG. 2 is an enlarged fragmentary portion of the structure shown in FIG. 1 with such fragmentary portion being shown in cross-section.

Referring now in greater detail to FIG. 2, the accelerating pump means and system 54 is illustrated as comprising housing means 52 which, in turn, comprises first housing and second housing portions or sections 56 and 58 with housing section 56 being preferably integrally formed with fuel bowl structure 48 and housing section 58 being a closure-like end member which may be generally circular when viewed from either axial end.

A movable wall or diaphragm 60 is peripherally contained between and retained by cooperating juxtaposed annular surfaces or faces 62 and 64 of housing sections 56 and 58 as to thereby define, at opposite sides of said diaphragm, variable and generally distinct chambers 66 and 68. If desired, additional annular sealing means or the like may be provided as depicted at 70.

Diaphragm backing plates 72 and 74, situated at opposite sides of the diaphragm 60 are operatively secured to each other and to diaphragm 60 as by an extension portion 76 passing therethrough and being generally peened over and against related annular washer or spacer means 78. Portion 76 is an axial extension of a generally cup-like cylindrical member 80 which is slidably received as within a cooperating cylindrical recess 82 formed within a general axial extension 84 of housing section 58. The cylindrical recess 82 may have an effective axial end wall as at 86 through which a generally vertically directed slot 88 is formed (with one surface 90 thereof being shown) as to accomodate the reception, in such slot, of an arm portion 92 of an actuating linkage or lever means 94 which may be pivotally secured within slot 88 and to extension 86 as by pivot means 96. A second cup-like cylindrical member 98 is slidably received within member 80 and axially contained therewithin as by peened over or inwardly formed portions 100. A compression spring 102 axially contained between members 80 and 98 serves to continually resiliently urge member 98 against stop or retainer portions 100 as generally depicted. As can be seen, the space generally between the outer cylindrical surface of member 80 and the inner cylindrical surface of recess 82 as well as the slot 88 serve to provide continual communication as between ambient atmosphere and chamber 68.

Figure 3:
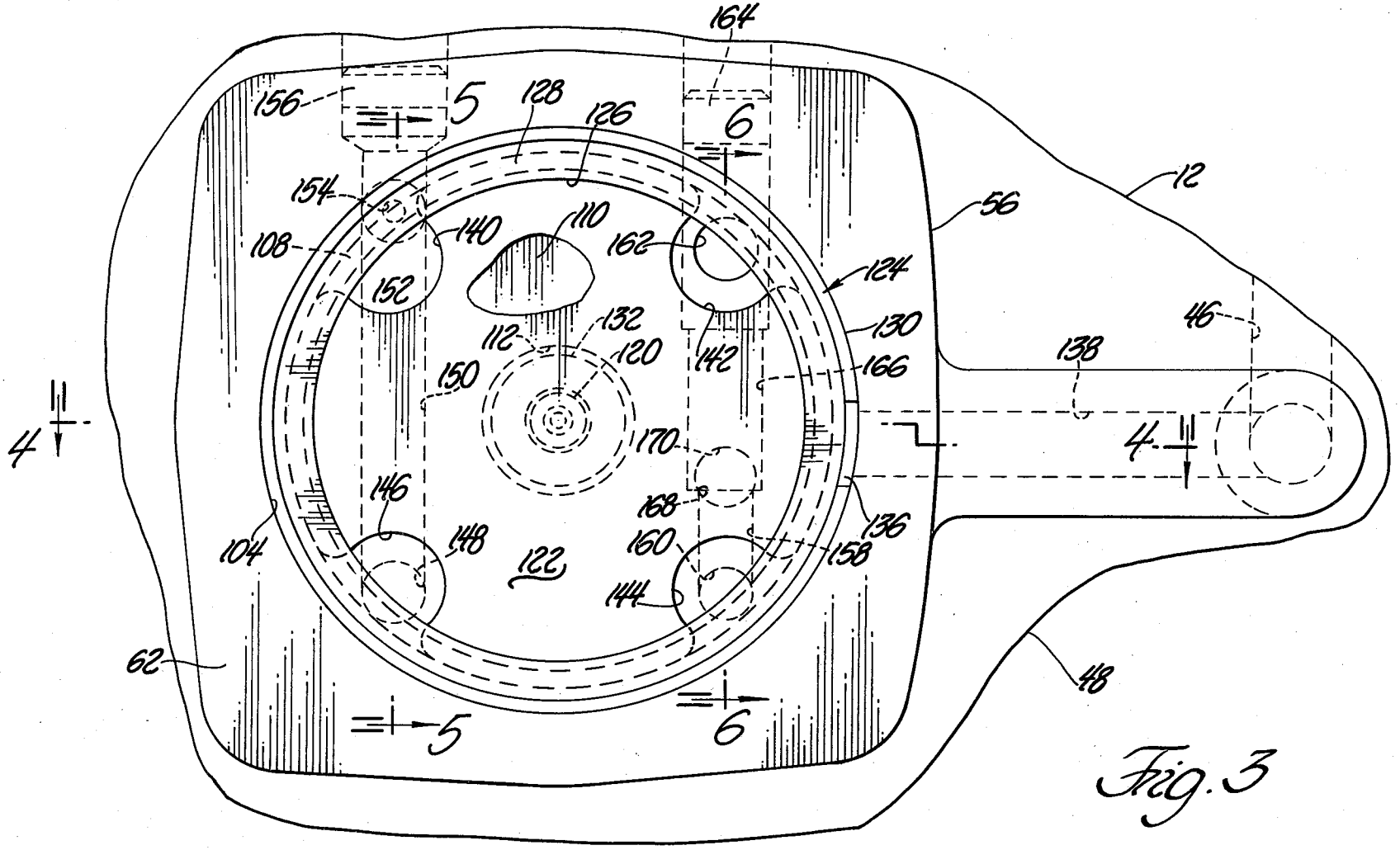
FIG. 3 is a view taken generally on the plane of line 3—3 in FIG. 2 and looking in the direction of the arrows.
Figure 5:
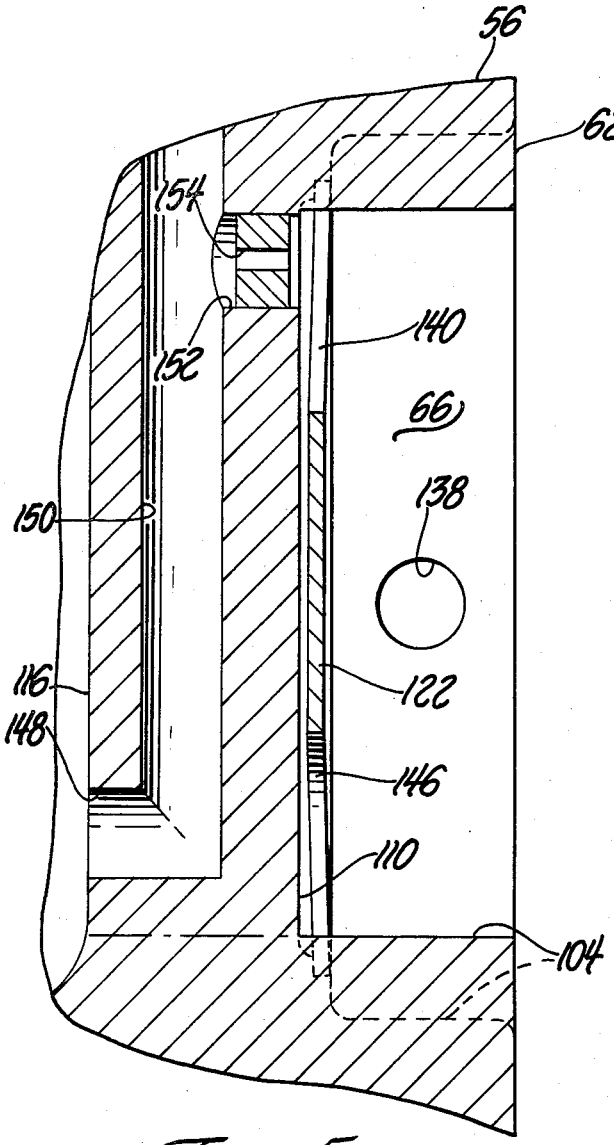
FIG. 5 is a fragmentary cross-sectional view taken generally on the plane of line 5—5 of FIG. 3 and looking in the direction of the arrows.
Figure 6:
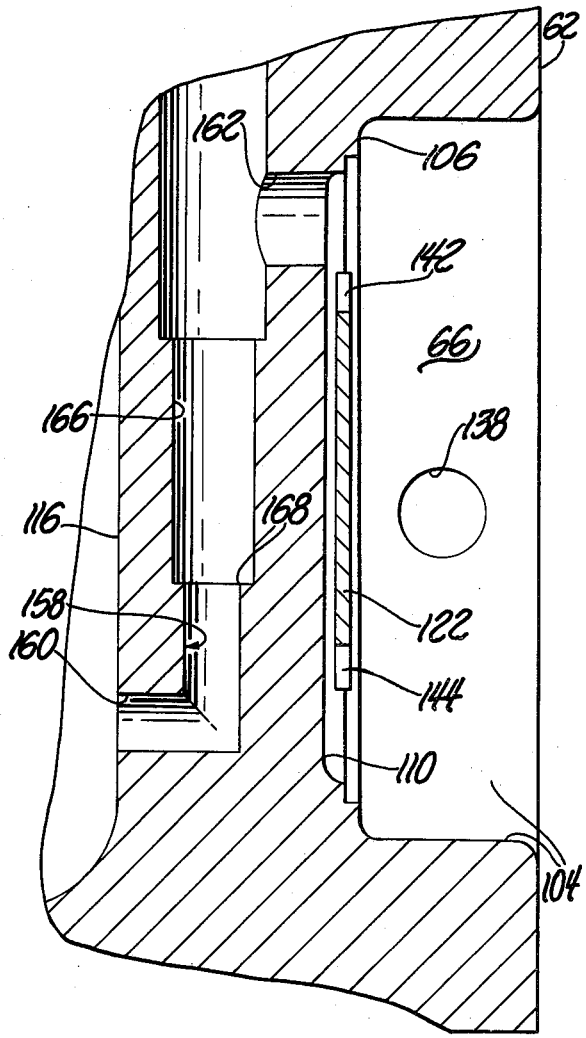
FIG. 6 is a fragmentary cross-sectional view taken generally on the plane of line 6—6 of FIG. 3 and looking in the direction of the arrows.

As is also shown in FIG. 3, chamber 66 is also defined as by a generally cylindrical side wall 104 which, at its left end as viewed in FIG. 2, terminates in an annular radially inwardly directed shoulder 106 which, in turn, at its radially innermost portion terminates in an annular stepped or counterbore having a radially inwardly directed flange or shoulder-like surface 108. An end wall 110, axially spaced to the left of surface 108, joins shoulder-like surface 108 as along its radially outermost periphery. End wall 110 also has a recess or chamber portion 112 formed therein which, through conduit means 114, is effectively in communication with fuel bowl chamber 116 containing fuel which may be at a level as generally depicted at 118. As shown, conduit means 114 comprises calibrated flow restriction means 120.

A generally disc-like thermostatic or bimetal member 122 is situated within chamber 66 as to have its peripheral portion seated against annular surface 108, while a cup-like member 124, with an aperture 126 formed through the end wall 128 thereof, has its outer cylindrical surface 130 closely received, or even press-fitted, within coacting surface 104 of chamber 66. When cup or retainer member 124 is axially seated as against shoulder 106 the end wall 128 serves to retain the peripheral portion of thermostatic member 122 against annular surface 108. When thermostatic member 122 is at a temperature less than a predetermined magnitude, it assumes a disked configuration as generally depicted in FIG. 2 thereby generally resiliently engaging and sealing against an annular or O-ring type resilient seal 132 thereby also causing the axially opposite side of seal 132 to sealingly engage against the surface of recess 112. Consequently, during such times that portion of recess 112 generally contained within the annular confines of seal 132 continues to be in communication with conduit means 114 but has its communication with chamber 66, of which wall 110 forms a portion, terminated.

A coil compression spring 134, contained generally within chamber 66, has one end seated as against retainer member 124 while its other end is operatively seated against diaphragm 60. Spring means 134 normally urges diaphragm 60 to the position generally depicted in FIG. 2. Further, in the embodiment disclosed, retainer 124 has a clearance cut-out portion 136 formed in the side wall thereof as to permit communication as between chamber 66 and discharge conduit means 138 formed in extension portion 56 and carburetor body means 12 leading to and communicating with means or portion 46 of FIG. 1.

Referring to FIG. 3, it can be seen that the thermostatic member 122 is provided as with a plurality of relieved or cut-out portions 140, 142, 144 and 146 which extend generally radially inwardly from the outer periphery thereof. Such relieved portions serve to function as passage or conduit means for continually maintaining an effectively unrestricted communication with both portions of chamber 66 which are situated respectively generally at opposite sides of the thermostatic member 122.

As shown in FIGS. 2, 3, 4, 5 and 6, additional passage or conduit means are also formed as to, in the manner to be described, communicate between fuel bowl chamber 116 and pump chamber 66. More specifically, a first generally vertically extending conduit 150 is, at its lower end, in communication as with a generally horizontally disposed conduit 148, in turn, communicating with fuel bowl chamber 116 and the fuel 118 contained therein. The upper portion of conduit 150 is placed in communication with pump chamber 66 as by conduit means 152 which may comprise calibrated flow restriction means 154. The upper portion of conduit means 150, as may otherwise extend above passage 152, is suitably closed as by plug or closure means 156. Somewhat similarly, a second generally vertically extending conduit means 158 communicates at its lower end with a generally horizontally disposed conduit 160, in turn, communicating with fuel bowl reservoir or chamber 116 and the fuel 118 contained therein. The upper portion of conduit 158 is placed in communication with pump chamber 66 as by conduit means 162. The upper portion of conduit means 158, as may otherwise extend above passage 162, is suitably closed or sealed as by plug or closure means 164. Preferably conduit means 158 is formed as to provide a relatively cross-sectionally enlarged portion 166 thereby defining an annular portion or seat surface 168 which cooperates as with a ball check valve member 170 (which may be additionally weighted or spring loaded toward its seated condition if such be desired).

Referring to FIG. 2, the throttle shaft 38 is shown fixedly carrying an actuating cam 172 for rotation therewith. Lever 94 has its other arm portion 174 provided with a generally laterally disposed cam follower portion 176 which is positioned generally in the path of rotation of cam 172 as it is rotated by throttle shaft 38.

Operation of the Invention

Generally, as the throttle valve 36 is rotated from or near curb idle position to a position more nearly or even closely approaching a wide open throttle position, cam 172 is rotated from the position shown in solid line to that position generally depicted in phantom line and lever cam follower portion is likewise thereby displaced from the position shown in solid line to that position generally depicted in phantom line. As follower 176 is thusly displaced, lever arm 92 is rotated counterclockwise about pivot 96 causing a related movement of diaphragm 60 and a diminution of the volume of chamber 66 causing a displacement of fuel from within said chamber 66.

The operation of the invention and the various benefits and aspects thereof can better be appreciated if certain conditions are first established and/or assumed. That is, let it be assumed that the associated engine is relatively cold, the fuel 118 within the fuel bowl chamber 116 is at the same relatively cold temperature, the fuel bowl structure 48 is also at the same relatively cold temperature and at an elevation equal to or above the maximum elevation of pump chamber 66, the pump means comprising diaphragm 60 has been actuated in its intake stroke (namely, moved from left to right to the position shown in FIG. 2), and the engine is operating at, for example, curb idle or even at low part throttle. Under such conditions it can be seen that because of the pump means undergoing an intake stroke, fuel has flowed from reservoir chamber 116 through conduit means 160 upwardly unseating check valve 170 and flowed through conduit portion 166 and conduit means 162 into and filling pump chamber 66. The fuel thusly brought into chamber 66 contacts thermostatic valve member 122 and because of the relatively cold temperature of the fuel, valve member 122 remains in the depicted configuration thereby effectively preventing flowing communication between pump chamber 66 and reservoir chamber 116 via conduit means 114 because of the sealing action of seal member 132 brought about by member 122 acting thereagainst.

Now assuming that throttle valve 36 is moved toward wide open throttle position, as, for example, when the vehicle operator demands engine acceleration or the like, lever 94 will be rotated generally counter-clockwise about pivot 96 causing arm 92, through members 98 and 80, to move diaphragm 60 to the left (as viewed in FIG. 2) against the resilient resistance of spring 134 thereby displacing fuel from chamber 66.

Primarily, the fuel thusly displaced is forced through conduit means 138 and conduit means 46 to discharge from accelerating fuel nozzle means 44 into the induction passage means 14. If desired, for purposes such as calibration or the like, related flow restriction means may be provided generally in the conduit means leading to the discharge of accelerating fuel into the induction passage means as, for example, depicted at 180 of FIG. 4. In the preferred embodiment, as illustrated, a flow path is always open from pump chamber 66 to fuel bowl chamber 116 with such being defined by the flow restrictor 154, conduits 152, 150 and conduit 148. Accordingly, whenever pump means 60 is actuated in its pumping stroke, a certain portion of the fuel contained within pump chamber 66 is forced or pumped back into fuel reservoir 116 via 154, 152, 150 and 148. The amount of fuel thusly returned (during any pumping stroke) to the reservoir 116, of course, depends on the effective flow area of restrictor means 154. Consequently, in the preferred embodiment of the invention, restriction means 154 is selected as to have an effective flow area which will result in only such amount of fuel being returned to reservoir 116 as to have the desired quantity of additional fuel pumped through nozzle means 44 into induction passage means 14 during relatively cold engine operation.

Now let it be assumed that the engine has been running for a time sufficient to heat the engine to a selected engine temperature. Since the carburetor structure is usually situated as to be thermally affected by the engine temperature, the fuel within fuel reservoir 116 also becomes heated in response thereto. The fuel, during engine operation, will obviously be at a temperature lower than the engine and and somewhat lower than the temperature of the carburetor structure but nevertheless at a temperature relatively elevated when compared to its temperature during cold engine operation.

If it is further assumed that because of the attainment of said selected engine temperature the fuel has attained a preselected relatively hot temperature, the fuel within pumping chamber 66 touching thermostatic valve member 122 will cause member 122 to move away from seal 132 and thereby open a second flow path between pump chamber 66 and reservoir chamber 116, with such being generally defined by recess 112, restrictor means 120 and conduit means 114. Now, during such relatively hot engine operation, when pumping means 60 is actuated in its pumping stroke there is an effectively increased flow path for returning fuel to the reservoir. That is, such flow path now includes thh effective flow area of restriction means 154 and restriction means 120. Consequently, at every pumping stroke a proportionately increased amount of fuel is returned to the reservoir 116 and a correspondingly decreased amount of additional fuel is discharged through nozzle means 44 into induction passage 14. Since, as previously stated, the relatively hot engine requires less amounts of additional accelerating pump fuel, restriction means 120 is selected as to have an effective flow area which will result in the amount of fuel being returned to reservoir 116 to be increased only sufficiently as to have the quantity of additional fuel pumped into induction passage 14 decreased to the desired amount for such relatively hot engine operation.

Accordingly, it can be seen that the invention provides means directly responsive to fuel temperature and at least directly related to engine temperature for altering the quantity of additional fuel discharged into the induction passage means by the accelerating fuel pumping means as to thereby meet the then existing conditions and parameters of engine operation.

In the event it may not be already apparent, the preferred embodiment of the invention also provides additional features and/or benefits. For example, by having conduit means 152 communicating with pump chamber 66, at a relatively high elevation, enables any fuel vapor which may be generated within pump chamber 66, due to, for example, excessive temperature build-up, to be returned to the reservoir chamber 66 through such conduit means 152. Further, an additional benefit, in connection with such fuel vapor, is realized by the placement of conduit means 148 at a relatively low elevation as to be below the normal level of the fuel within reservoir chamber 116. That is, as such fuel vapor passes through conduit means 152, 150 and 148, the vapor, in effect, is caused to percolate through the liquid fuel thereby condensing into a liquid form of fuel again and reducing the otherwise existing vapor pressure. By thusly returning fuel vapor to the fuel bowl chamber 116 also prevents such vapor from itself forcing fuel, during undesired periods, through conduit means 138 and 46 into induction passage means 14.

Figure 7:
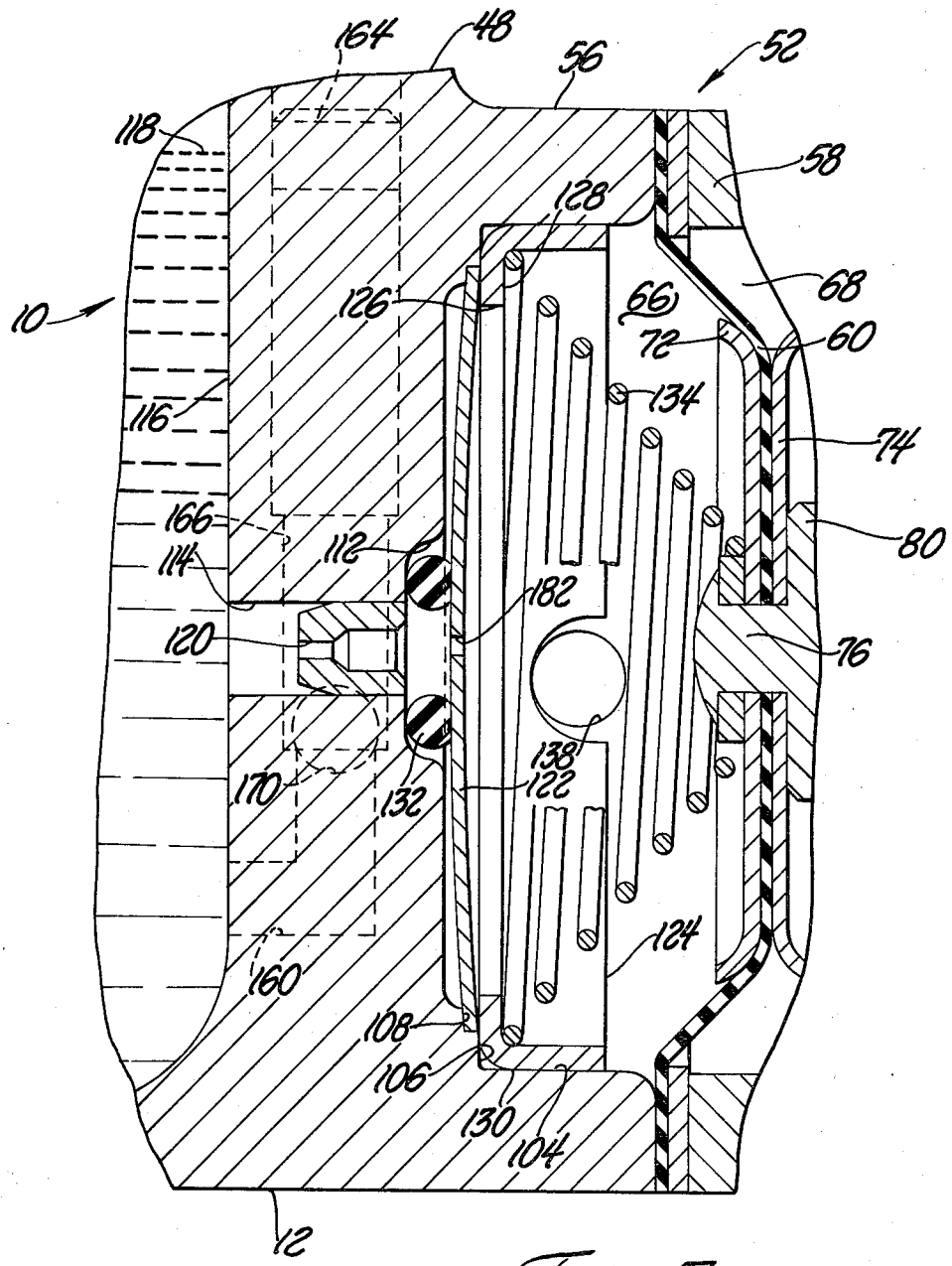
FIG. 7 is a fragmentary cross-sectional view generally similar to FIG. 2 but illustrating a modification of the invention.

FIG. 7, a fragmentary view similar to that of FIG. 2, illustrates a modification of the invention. Such elements in FIG. 7 which are like or similar to those of the preceding Figures, and as are necessary to the understanding of such modification, are identified with like reference numbers.

In the modification of FIG. 7, it can be seen that the thermostatic valving member 122 is provided with a generally centrally disposed calibrated aperture or passage means 182 formed therethrough as to be in continued communication with passage means 114 and calibrated restriction means 120. Obviously, this communication can be achieved by the location of passage means 182 being anywhere radially inwardly of the annular seal 132.

In the arrangement of FIG. 7, when the temperature of the fuel is below a preselected relatively hot temperature, thermostatic valving member 122 remains closed against seal 132; however, because of calibrated passage 182 there continues to be communication between pump chamber 66 and fuel bowl chamber 116. Therefore, when pumping means 60 is actuated in its pumping stroke, as generally described before, a portion of the fuel displaced by the pumping means 60 is now pumped through restriction 182 and into fuel bowl chamber 116 via 120 and passage 114. In this arrangement, restriction 182 has an effective flow area less than the effective flow area of series restriction 120. Therefore, during the time that thermostatic member 122 is closed against seal 132 restrictor 120 exhibits virtually no effect on the flow into reservoir 116 due to pumping means 60 forcing a portion of the displaced fuel through series calibrated passage means 182.

Of course, when the temperature of the fuel attains the preselected relatively hot temperature, thermostatic member 122 will move away from seal 132 and the amount of fuel pumped or bled back to fuel bowl chamber 116, at each pumping stroke, will increase to that amount then determined by restriction means 120.

In the practice of the embodiment as disclosed in FIG. 7, the means, and mode of operation, as otherwise disclosed in FIGS. 1–6 may be employed. Further, however, in the preferred embodiment of the modification of FIG. 7, the passage means defined by conduit means 152, restriction means 154 and conduit means 150 and 148 may be, and preferably is, omitted.

The invention as thus far described provides for either a series arrangement of bleed passages or a parallel arrangement of bleed passages, thermostatically controlled, for returning or bleeding back into the fuel bowl chamber, a portion of the fuel being pumped by the accelerating pump means. It should be apparent that other arrangements are also possible and that a plurality of thermostatic means could be employed in cooperative combination with a plurality of passages as to thereby result in a plurality of different quantities of such fuel being bled back to the fuel bowl spanning the range of engine temperatures from a predetermined relatively cold engine to a predetermined relatively hot engine.

Although only a preferred embodiment and a modification of the invention has been disclosed and described, it is apparent that other embodiments and modifications of the invention are possible within the scope of the appended claims.

I claim:

1. A carburetor accelerating pump for discharging a first quantity of fluid when the fluid is at a first temperature and a second quantity of fluid when the fluid is at a second temperature, comprising body means formed to provide a pumping chamber having a movable wall, an inlet communicating between said pumping chamber and an associated source of supply of said fluid, a discharge outlet communicating between said pumping chamber and an associated fluid consuming area, movement in one direction of said movble wall with respect to said chamber causing said fluid to be drawn into said pumping chamber through said inlet and movement in an other direction of said movable wall causing fluid to be pumped from said pumping chamber, first calibrated passage means effectively communicating between said pumping chamber and said source of supply of said fluid, said first calibrated passage means being effective to cause a first portion of said fluid being pumped from said pumping chamber to be returned to said source of supply while permitting the remaining portion of said fluid being pumped from said pumping chamber to be pumped into said discharge outlet, and second calibrated passage means effective to communicate between said pumping chamber and said source of supply of said fluid, said second calibrated passage means being effective to meter a second portion of a magnitude different from said first portion of said fluid being pumped from said pumping chamber to be returned to said source of supply while permitting the then remaining portion of said fluid being pumped from said pumping chamber to be pumped into said discharge outlet, said first and second calibrated passage means being in series flowing relationship to each other when said first portion of said fluid is being returned to said source, and temperature responsive valving means operatively associated with at least one of said calibrated passage means to effectively remove said first and second calibrated passages from series flow relationship when said fluid attains a preselected temperature.

2. A fluid pump according to claim 1 and wherein said first calibrated passage means is formed through said temperature responsive valving means.

3. An accelerating pump for a combustion engine fuel system, comprising a pumping chamber having movable wall means, inlet means communicating between said pumping chamber and an associated source of supply of said fuel, discharge outlet means communicating between said pumping chamber and an associated fuel consuming area, said movable wall causing said fuel to be drawn into said pumping chamber through said inlet means or discharged from said pumping chamber into said discharge outlet means depending on the direction of movement of said wall means, bleed passage means effective for providing communication between said pumping chamber and said source of supply of said fuel, said bleed passage means being effective to return a portion of said fuel from said pumping chamber to said source of supply of said fuel during such times as said fuel is being discharged into said discharge outlet means, and thermostatic means responsive to the temperature of said fuel within said pumping chamber for varying the effective flow area of said bleed passage means as to thereby alter the magnitude of said portion being returned to said source of supply, said bleed passage means comprising a first calibrated flow passage and a second calibrated flow passage, said first and second flow passages being in series circuit with each other during such times as when said fuel is below a preselected temperature, said thermostatic means being operative to effectively take said first and second flow passages out of said series circuit when said fuel attains said preselected temperature.

4. An accelerating pump according to claim 3 wherein said second calibrated flow passage means is formed through said thermostatic means.

5. An accelerating pump according to claim 4 wherein said thermostatic means comprises a disc-like snap acting bimetallic member.

6. An accelerating pump according to claim 3 wherein said thermostatic means comprises valving means effective to maintain a portion of said bleed passage means closed when said fuel is at a temperature below a preselected temperature.

7. An accelerating pump according to claim 3 wherein said bleed passage means comprises a first calibrated passage and a second calibrated passage, wherein said thermostatic means comprises thermostatic valving means associated with said second calibrated passage, and wherein said thermostatic means acts to lessen communication between said pumping chamber and said source of supply when said fuel is at a temperature less than a preselected temperature.

8. An accelerating pump according to 7 wherein said thermostatic valving means comprises a disc-like thermostatic member situated within said pumping chamber, and a seal generally circumscribing said second calibrated passage, said thermostatic member being effective when the temperature of said fuel is less than said preselected temperature to sealingly engage said seal and thereby terminate the otherwise communication through said second calibrated passage.

9. An accelerating pump according to claim 8 wherein said pumping chamber comprises a cup-like cavity having structural end wall means generally separating said cavity from said source of supply of said fuel, wherein said second calibrated passage is formed through said structural end wall means, and further comprising recess means formed in said structural end wall means at the cavity side thereof and generally circumscribing said second calibrated passage means, wherein said seal comprises an O-ring sealing member generally situated within said recess means, wherein said thermostatic member is retained generally in juxtaposition to said structural end wall means as to at times be effective to seal against said O-ring member and at other times move away from said O-ring member, and resilient means for resiliently urging said movable wall means in a direction away from said thermostatic member.

10. An accelerating pump according to claim 9 and further comprising an annular retainer member received within said cavity and effective to hold said thermostatic member juxtaposed to said structural end wall means, and wherein said movable wall means comprises diaphragm means.

11. An accelerating pump according to claim 10 wherein said resilient means comprises spring means situated within said cavity and operatively engaging said diaphragm means and said retainer member.

* * * * *